US006139690A

United States Patent [19]

Halmschlager et al.

[11] Patent Number: 6,139,690

[45] Date of Patent: Oct. 31, 2000

[54] FORMER WITH A FLOATING UPPER LIP

[75] Inventors: Günter Halmschlager, Krems; Herbert Haunlieb, Loosdorf, both of Austria

[73] Assignee: Voith Sulzer Papiermaschinen GmbH, Heidenheim, Germany

[21] Appl. No.: 09/107,482

[22] Filed: Jun. 30, 1998

[30] Foreign Application Priority Data

Jul. 1, 1997 [DE] Germany ..... 197 27 929
Nov. 3, 1997 [DE] Germany ..... 197 48 460

[51] Int. Cl.[7] ..... D21F 1/04

[52] U.S. Cl. ..... 162/344; 162/347; 162/336; 162/317

[58] Field of Search ..... 162/336, 343, 162/344, 347, 259, 315

[56] References Cited

U.S. PATENT DOCUMENTS

| | | | |
|---|---|---|---|
| 3,645,843 | 2/1972 | Schmaeng | 162/347 |
| 3,853,695 | 12/1974 | Back et al. | 162/347 |
| 3,909,349 | 9/1975 | Stotz et al. | 162/317 |
| 3,947,317 | 3/1976 | Stotz et al. | 162/347 |
| 4,154,649 | 5/1979 | Stotz et al. | 162/347 |
| 4,342,619 | 8/1982 | Gladh | 162/347 |
| 4,358,342 | 11/1982 | Nutall | 162/347 |
| 4,980,026 | 12/1990 | Kade | 162/336 |

FOREIGN PATENT DOCUMENTS

| | | |
|---|---|---|
| 106593 | 4/1984 | European Pat. Off. . |
| 2322445 | 10/1974 | Germany . |
| 3125278 | 6/1982 | Germany . |
| 29508352 | 9/1995 | Germany . |

*Primary Examiner*—Karen M. Hastings
*Attorney, Agent, or Firm*—Greenblum & Bernstein, P.L.C.

[57] ABSTRACT

A former with a sieve, preferably with a cylinder mold, is provided with an adjustable discharge aperture for a fibrous material suspension exiting from a chamber that is formed between the sieve and an upper lip formed by a flow guide plate. The upper lip has a first end facing away from the chamber and is guided in a floating manner by a pressure medium in a direction toward the sieve, as well as in the opposite direction. The upper lip is supported in a floating manner also by a pressure medium at its second end facing toward the chamber. In this way, deflections of the upper lip in the region of the inlet aperture can be largely avoided.

22 Claims, 3 Drawing Sheets

FORMER WITH A FLOATING UPPER LIP

CROSS-REFERENCE TO RELATED APPLICATIONS

The present application hereby claims priority under 35 U.S.C. 119 of German Patent Application Nos. 197 27 929.5 and 197 48 460.3 filed on Jul. 1, 1997 and Nov. 3, 1997, respectively, the disclosures of which are expressly incorporated by reference herein.

BACKGROUND OF THE INVENTION

1. Field of the Invention

The invention relates to a former with a sieve which is constructed as a cylinder mold, so that an adjustable discharge aperture for a fibrous material suspension exiting from a chamber is formed between the sieve and an upper lip formed by a flow guide plate. The upper lip can be adjusted in the direction of the sieve by means of a pressure medium 2. Discussion of Background Information A former of the foregoing type is known from DE 31 25 378 A1. In this former, a web forming zone is formed, in which the fibrous material suspension, under pressure, passes from a supply channel into an aperture between a cylinder mold and a flow guide plate. The beginning of the aperture is defined between a lower lip and an upper lip, while at the end of the opening, an exit aperture is defined between the sieve and the upper lip. The upper lip in this case is comprised of individual elements that are hinged together. A fixed stop is provided to adjust the exit aperture. The upper lip can be adjusted against the fixed stop with the aid of a spring bellows, which can be acted on hydraulically.

The known arrangement has the disadvantage that the discharge aperture is rigidly defined by the fixed stop and, thus, changes in the web thickness can result from a number of different influential parameters, such as eccentricity of the sieve, changes in the composition of the fibrous material suspension, changes in the feed pressure, etc.

For these reason, in another former marketed under the name "FloatLip Former," the upper lip is acted on aided by a pressure tube, actuated with the aid of a pressure medium, against the sieve. In this manner, relatively uniform support can be achieved through contact of the upper lip, and malformations resulting from deflection/cambering can be prevented. The upper lip can move along with the imperfections of the cylinder mold so that the discharge aperture remains relatively constant.

Nonetheless it has been seen that, even in the known former, variations in the draining pressure resulting from, for example, different degrees of beating the fibrous material suspension or from eccentricities in the sieve still can appear, whereby variations in the thickness of the paper or cardboard web can result. Moreover, the known former does not yet permit a precise, fine adjustment of the draining pressure.

A former with a similar design is known from U.S. Pat. No. 3,645,843. The discharge aperture is delimited by an upper lip that is hinged on the side facing the chamber and is adjustable in the direction of the sieve by means of a pressure medium on the side facing away from the chamber.

Another embodiment of a similar design is known from DE-A-295 08 352. In this embodiment as well, an upper lip of a discharge aperture is adjustable on its end turned from the chamber, in the direction of the sieve by means of a pressure medium.

The embodiments described above all have the disadvantage that variations in the draining pressure can still occur as a result of differing degrees of beating of the fibrous material suspension or eccentricity of the sieve, which can result in variations in the thickness of the paper or board web produced. Moreover, the known formers still do not permit a precise adjustment of the draining pressure.

SUMMARY OF THE INVENTION

Consequently, an object of the present invention is to create an improved former in which the draining pressure can be kept more or less constant regardless of variations in the various influence parameters, and which will permit a precise adjustment of the draining pressure.

This object is achieved in accordance with the invention by a former of the type initially discussed, in that the upper lip is arranged by means of the pressure medium so as to be guided to be adjustable toward the sieve as well as in the opposite direction.

In accordance with the invention, the movement of the upper lip by the pressure medium, toward the sieve as well as in the opposite direction, achieves a defined position of the upper lip relative to the sieve. The result is a floating position of the upper lip, which is defined toward the sieve as well as in the opposite direction. The draining pressure can then be kept constant independent of the degree of beating, and eccentricities in the sieve can be compensated. The formation of a differential force between the effect of the pressure medium in the direction toward the sieve and the effect of the pressure medium in the opposite direction brings about the capability for a particularly precise metering of the draining pressure.

Despite the fact that a second pressure tube, capable of effecting an enlargement of the discharge aperture, may be possible in the known FloatLip former, discussed above, such possibility does not suggest the present invention, since the second pressure tube would have no function in normal operation and is only activated in problem situations to achieve an emergency lifting of the upper lip from the sieve.

In accordance with an advantageous further development of the invention, the first end of the upper lip turned from the chamber is guided in a floating manner by at least two pressure tubes, so that one of the two pressure tubes exerts a force on the sieve when acted on by the pressure medium, and the second of the two pressure tubes exerts an opposing force when acted on by the pressure medium.

In this way, a particularly precise and well defined guidance of the upper lip can be achieved to adjust the exit aperture and the draining pressure. It is advantageous for the two pressure tubes to extend parallel to one another, transverse to web run direction, in the axial direction of the former. However, other geometric arrangements of the pressure tubes are also possible.

Furthermore, it is also feasible to use other pressure media to set the position of the upper lip, i.e., for instance, fluid sleeves located along the upper lip that act in the direction toward the sieve as well as in the opposite direction, or double-acting hydraulic cylinders or other elastic elements, such as spring units. However it has been observed that the use of hydraulically or pneumatically pressurized pressure tubes permits an especially simple construction and, additionally, an especially uniform control of the draining pressure over the entire width of the web.

In a further development of the invention, the upper lip is mounted to rotate on a swivel axis at its second end which faces the chamber.

This method has the advantage that a low friction in the inlet aperture adjustment region results from the precisely defined axis of rotation, as compared to the conventional FloatLip Former where, due to the rigid placement of the upper lip in the region of the inlet aperture, increased friction and bending forces had to be overcome.

In another further development of the invention, the upper lip is attached to a stiffening element that is guided at its first end by means of the two pressure tubes and, at its second end, is fastened to rotate about the axis of rotation.

In accordance with another aspect of the invention, a carrier is provided that can be locked in a fixed position, and, on the first side of which faces the sieve, a first pocket for accommodating the first pressure tube is formed by a spacer to the stiffening element, and, on the second side of which faces away from the sieve, a second pocket for accommodating the second pressure tube is formed by a strap that is rigidly attached to the stiffening element.

By the foregoing arrangements, the upper lip, which is not by itself adequately resistant to bending, is supported in a defined manner, and a defined position of the pressure tubes is ensured in a simple way in order to guide the upper lip in a defined way via the differential forces between the two pressure tubes.

In another development of the invention, one of the two pressure tubes, preferably the second pressure tube, is acted on by a constant working pressure, while the other pressure tube is acted on by an adjustable working pressure. Control of the two pressure tubes is simplified in this way.

In another development of the invention, one of the two pressure tubes, preferably the second pressure tube, is coupled with a device for lifting the upper lip from the sieve at startup and shutdown, as well as when a problem situation occurs.

It is thus ensured in this way that, in case of a problem situation, for example, the presence of relatively large, foreign bodies in the fibrous material suspension, the upper lip is raised quickly from the sieve to enlarge the exit aperture, to avoid damage to the wire mesh. In addition, the upper lip is raised at startup and shutdown in order to avoid damage to the sieve in the absence of draining pressure.

In accordance with a further development of the invention, a device is provided which adjusts the distance between a swivel axis and the sieve to set the inlet aperture formed between the upper lip and the lower lip.

By this arrangement, in addition to the defined adjustment of the exit aperture, the inlet aperture for the fibrous material suspension can also be changed in order to directly affect the web thickness.

In accordance with another development of the invention, the chamber, from which the fibrous material suspension passes into the inlet aperture between the upper lip and lower lip, is delimited by a flexible wall at the back end turned from the sieve.

By this arrangement, the changes resulting from a swiveling of the upper lip during adjustment of the exit aperture are easily compensated for by the flexible wall.

In accordance with another development of the invention, a movable stop is provided for the upper lip in order to limit forward motion of the upper lip toward the sieve.

By this arrangement, damage to the delicate sieve is avoided during phases in which no draining pressure is yet present in the discharge aperture, i.e., while stationary and during startup.

In accordance with a further development of the invention, the upper lip is supported in a floating manner by a pressure medium at its second end facing the chamber.

By this arrangement, uniform support of the upper lip over the width of the machine is ensured, whereby the inlet aperture remains adjustable, but a "floating mounting" is produced similar to that at the first end of the upper lip.

By this arrangement, a uniform size of the inlet aperture over the entire width of the machine is ensured and a deflection of the upper lip is avoided.

In an advantageous further development of the invention, the upper lip at its second end is guided in a floating manner between at least two pressure tubes.

In accordance with another embodiment of the invention, one of the pressure tubes exerts a force for adjustment in the direction of the sieve when acted on by a pressure medium, and another pressure tube exerts an opposing force when acted on by the pressure medium.

In this way, a particularly precise and well-defined guidance of the upper lip is achieved for adjustment of the inlet aperture and the draining pressure. The pressure tubes extend parallel to one another, transversely to the web run direction in the axial direction of the former.

In another aspect of the invention, the upper lip is attached to a stiffening element, which is guided at both the first end, turned from the channel, and the second end, facing the channel, with the aid of at least two pressure tubes and is supported by a carrier.

In this way, the advantages of the floating support can be utilized with the aid of pressure tubes at both the first end of the upper lip, turned from the chamber, and the second end of the upper lip, facing the chamber.

In a preferred further development of the invention, the upper lip is supported at its second end by a number of swivel bearings distributed over the width of the machine on a cross strut, which is supported with the aid of pairs of adjacently running pressure tubes on the stiffening element, which run in pockets between the cross strut and the stiffening element on the side facing the sieve and in pockets between the cross strut and the support element rigidly connected to the stiffening element on the side turned from the sieve.

In accordance with another aspect of the invention, the stiffening element is equipped with a number of stiffening fins that are arranged at regular intervals over the entire width of the former and to each of which a swivel bearing is assigned for support.

Due to the large number of support locations, the result is support which is nearly linear and thus the upper lip is substantially straight and free of deflection across the entire width of the machine in the region of the inlet aperture. Moreover, the differential pressure between pairs of opposing pressure tubes permits an especially precise adjustment.

In accordance with another advantageous aspect of the invention, a pocket facing the sieve for accommodating a pressure tube is formed between the first end of the stiffening element turned from the chamber and a strap rigidly attached to the carrier; and a pocket facing away from the sieve for accommodating a pressure tube is formed between the carrier and the stiffening element. This aspect has the advantage that initial setting of the distance between the upper lip and the stiffening element is made possible without first removing the strap.

For this purpose, in another preferred development of the invention, a threaded spindle is provided which passes through the carrier and the stiffening element and engages with a threaded section of the stiffening element and the upper lip. The result is a simple mechanism for the initial setting of the discharge aperture or for profiling. A number of such adjustment mechanisms with threaded spindles can be distributed over the width of the machine here as well.

In accordance with another aspect of the invention, a transverse manifold, which is rigidly connected to the carrier by braces and which can be temperature controlled in such a way that the carrier remains free of deflection, is provided for the admixing of fluids in the chamber.

In this way, the transverse manifold, which is necessary in any case, contributes to stiffening of the carrier. A particularly advantageous feature is the utilization of thermal expansion with temperature control of the supplied fluid, in order to keep the carrier largely free of deflection without additional support measures.

In accordance with another advantageous aspect of the invention, at least one displacement sensor is provided for determining the position of the upper lip at its first end and/or its second end. The displacement sensor can be coupled with the threaded spindle or with one of the swivel bearings. In this way, an automatic adjustment of the inlet and discharge apertures can be achieved if the measured values are used as control variables when regulating the pressure applied to the pressure tubes.

BRIEF DESCRIPTION OF THE DRAWINGS

The present invention is further described in the detailed description which follows, in reference to the noted drawings by way of non-limiting examples of preferred embodiments of the present invention, wherein the same reference numerals represent similar parts throughout the several views of the drawings, and wherein.

DETAILED DESCRIPTION OF THE INVENTION

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention. The description taken with the drawings making apparent to those skilled in the art how the several forms of the invention may be embodied in practice.

Figure 1:
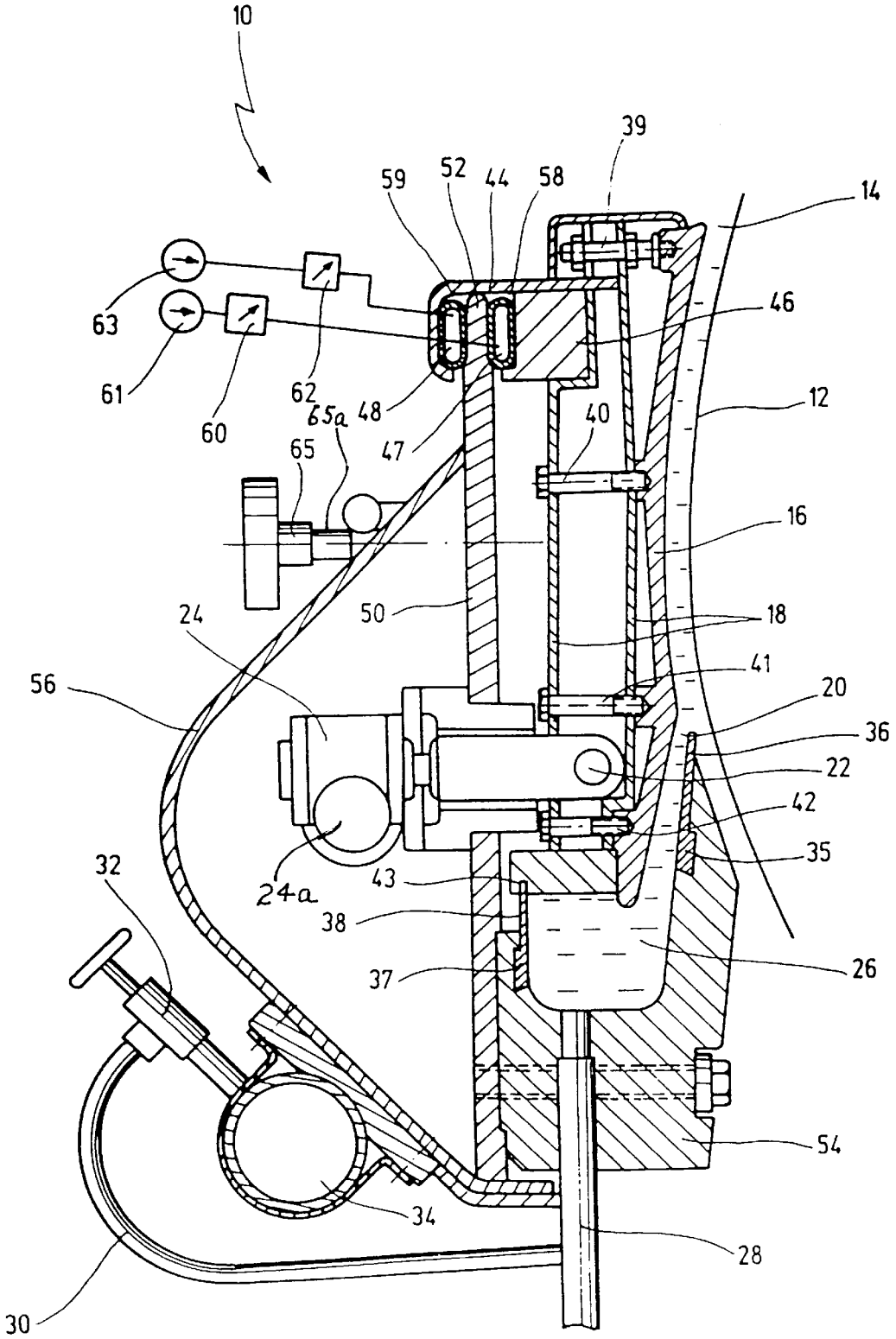
FIG. 1 is a cross-section through an initial embodiment of a former in accordance with the invention in the area of the adjusting device with upper lip adjustable toward the sieve.

In FIG. 1, a former in accordance with the invention is designated by reference numeral 10. Former 10 includes a forming roll, of which only the sieve 12 in the area of the web-forming zone is shown. The fibrous material suspension passes from a chamber 26, which is also called a mixing chamber, through an inlet aperture 20, which is formed between a lower lip 36 and an upper lip 16, into an aperture between the sieve 12 and the upper lip 16, the upper end of which defines an exit aperture 14.

While the lower lip 36 is attached to a massive foundation 54 of the former 10 by means of a dovetail guide 35, the upper lip 16 is mounted to rotate at its bottom end facing the mixing chamber 26 on a swivel axis 22 with the aid of a stiffening element 18. The other end of the upper lip, displaced from the mixing chamber 26, is guided in a defined way by two pressure tubes 47, 48 in a direction toward the sieve 12 and also in the opposite direction, in order to be able to set the draining pressure and keep the exit aperture 14 constant, independent of the degree of beating of the fibrous material suspension and independent of other parameters, such as eccentricities of the sieve, as will be discussed in detail below.

For this purpose, the upper lip 16, with screw connections 39, 40, 41 above the swivel axis 22 and with screw connections 42 below the swivel axis 22, is attached to the stiffening element 18, which can be a rectangular retaining plate.

In addition, a stable carrier 50 is fastened to the foundation 54 with screws. Connected to the carrier 50 is a support wall 56 at the end facing away from the sieve 12, which takes the form of an approximately symmetrical V-shaped trough with an obtuse angle of opening and the two sides of which touch the carrier 50 in the regions of the lower end and the upper end, and to which additional components are fastened.

In the mixing chamber 26, a fibrous material suspension is supplied from below through numerous lines 28 arranged adjacent to one another across the width of the former 10, into which thinning fluid is supplied from a channel 34 running laterally along the support wall 26 via valves 32 and thinning water lines 30 that terminate with a certain angle at the lines 20, so as to supply a fibrous material suspension to the mixing chamber in the desired concentration for achieving the desired basis weight profile.

At its rear end facing the sieve 12, the mixing chamber 26 is sealed by a flexible wall 38 in the form of a plastic lip that is attached to the foundation 54 in a dovetail guide 37 and that is gripped in a groove 43 on the opposite wall element. This flexible seal compensates for variations resulting from swiveling of the upper lip 16 around the swivel axis 22.

The swivel axis 22 itself is adjustable through an adjustment mechanism 24 by means of a setting spindle, in order to be able to adjust the spacing between the upper lip 16 and the lower lip 36, which determines the width of the inlet aperture 20.

Rigidly attached in cross-section to the upper end of the stiffening element 18 is an approximately L-shaped strap 44 which projects from the stiffening element 18 and embraces or covers the upper end 52 of the carrier 50. A spacer 46 between carrier 52 and the stiffening element 18 is provided on the side of the carrier 52 facing toward the sieve 12, so that a pocket 58 is formed between the carrier 52, the strap 44 at the upper end, and the spacer 46. The pocket 58 contains the first pressure tube 47.

An additional pocket 59, inside which the second pressure tube 48 is arranged, is formed on the opposite side of the carrier 50 between the carrier and the approximately L-shaped strap 44, the short leg of which at its outer end extends somewhat further in the direction of the sieve 12.

The first pressure tube 47 is acted on or actuated by a pressure source 61 via a control mechanism 60, while the second pressure tube 48 is likewise acted on or actuated by a pressure source 63 via a control mechanism 62. Air is used as the preferred pressure medium.

In normal operation, the outer pressure tube 48 is operated at constant pressure, while the inner pressure tube 47 is automatically controlled in accordance with the applicable operating conditions in order to maintain constant draining pressure in the discharge aperture 14.

The control mechanism 62 for the outer pressure tube 48 is operable in such a way that emergency lifting of the upper lip 16 from sieve 12 is possible in case of a problem situation, e.g., if coarse impurities appear in the fibrous material suspension.

During normal operation, in contrast, the size of the discharge aperture 14 and the level of draining pressure are set in a defined way by the pressure difference between the two pressure tubes 47, 48.

In addition, a stop 65 is provided, which is indicated only schematically and which is somewhat adjustable by means of a threaded spindle to establish a minimum size of the discharge aperture 14, up to which point a maximum swiveling of the upper lip 16 toward the sieve 12 is possible. This type of minimum discharge aperture size should be maintained for down-time and startup operation of the former in order to avoid damage to the sieve 12 when no draining pressure is present.

Figure 2:
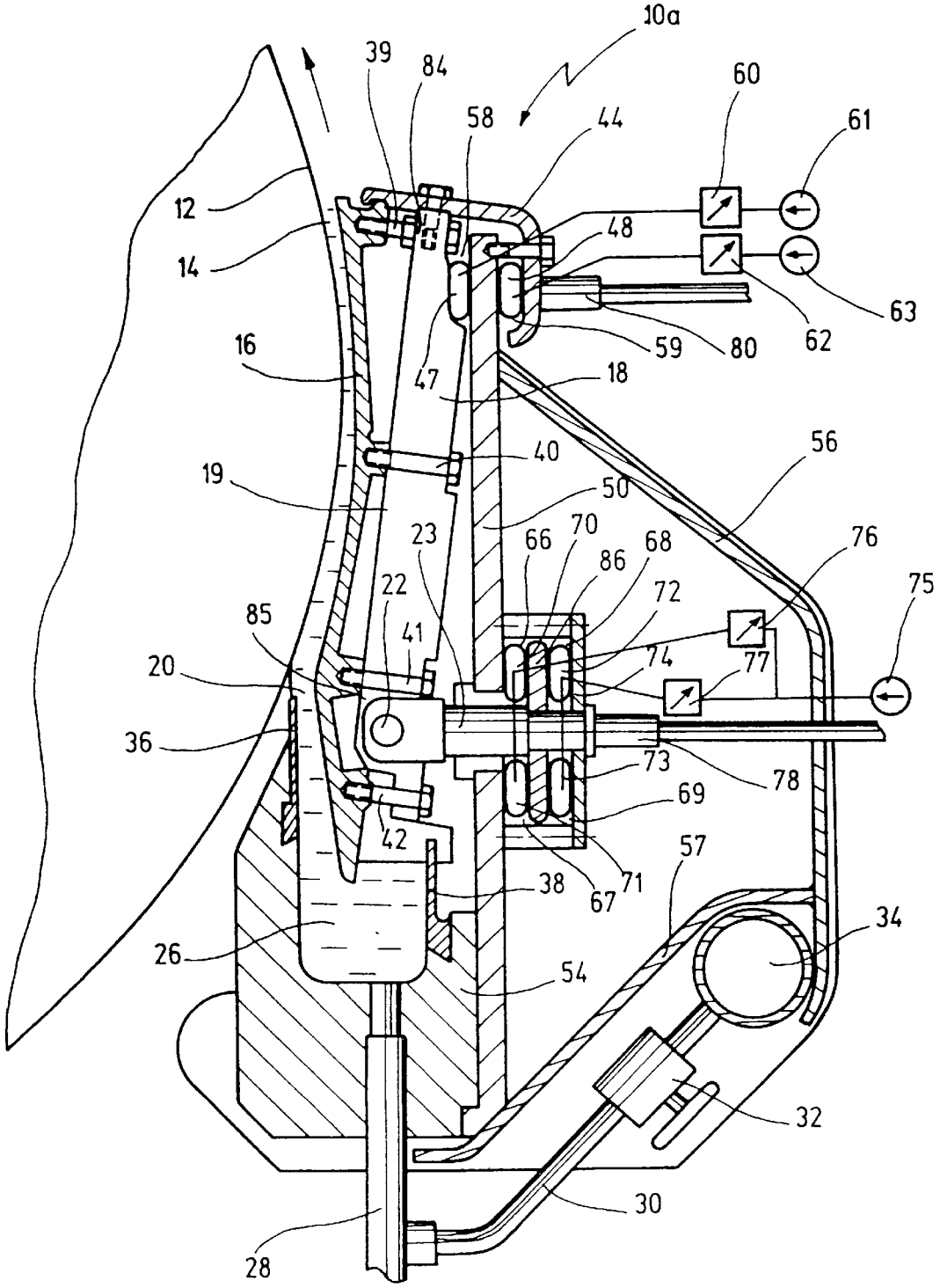
FIG. 2 is an embodiment of the former modified with respect to the embodiment as shown in FIG. 1; and, FIG. 3 is a further modification of the former as shown in FIG. 2.

In FIG. 2, a modified embodiment of a former in accordance with the invention is designated as a unit 10*a*. Corresponding reference numbers are used for the corresponding parts of FIG. 1.

Former 10*a* includes a forming roll, of which the sieve 12 is shown in the area of the web-forming zone. In this case, the fibrous material suspension passes from a chamber 26, which is also called a mixing chamber, through an inlet aperture 20, which is formed between a lower lip 36 and an upper lip 16, through the sieve 12 and the upper lip 16, where an exit aperture 14 is defined at the upper end between sieve 12 and upper lip 16.

While the lower lip 36 is attached to a massive foundation 54 of former 10*a* by a dovetail guide, the upper lip 16, with the aid of a stiffening element 18 is, with the aid of pressure tubes, supported largely uniformly at its lower end, which faces the mixing chamber 26, with the aid of a number of swivel bearings 22 on a cross strut 85 that engage in an articulated fashion on stiffening element 18. The other end of the upper lip, which faces away from the mixing chamber 26, is likewise supported in a floating manner by two pressure tubes 47, 48.

A carrier 50, which is fastened to the foundation 54 with screws, serves to stiffen the former 10*a* over the entire width of the machine. Also connected to the carrier 50 are support walls 56 and 57 at the end facing away from the sieve 12, which forms an approximately V-shaped trough, the two sides of which contact the carrier 50 in the regions of the upper end and the lower end, and to which additional components are fastened.

In the mixing chamber 26, a fibrous material suspension is supplied from below through numerous lines 28 arranged adjacent to one another across the width of the former 10, into which thinning fluid is supplied from a channel or transverse manifold 34 running laterally along the support wall 57 via valves 32 and thinning water lines 30 that terminate with a certain angle at the lines 28, so as to deliver the fibrous material suspension, a section at a time, to the mixing chamber 26 in the desired concentration for achieving the desired basis weight profile.

Screwed onto the upper end or first end 84 of the stiffening element 18 is an approximately L-shaped strap 44 which extends outward from the stiffening element 18 and embraces or covers the upper end of the carrier 50. A pocket 58 is formed between the carrier 50 and the stiffening element 18 on the side of the carrier 50 facing toward the sieve 12. The pocket 58 contains a first pressure tube 47.

An additional pocket 59, in which the second pressure tube 48 is arranged, is formed on the opposite side of the carrier 50 between the carrier and the approximately L-shaped strap 44, the short leg of which at its outer end extends somewhat further in the direction of the sieve 12. The two pressure tubes 47, 48 can be acted on or actuated with compressed air for instance, by a pressure source 61, 63 via a control mechanism 60, 62, using compressed air.

The first end 84 of the stiffening element 18 is connected with the end of the upper lip 16 by means of a threaded bolt 39, which engages in a threaded blind hole at the upper end of the upper lip 16. This makes it possible to plan an initial setting of the discharge aperture 14 or to preset a desired profiling over the width of the web.

At the first end, which faces chamber 26, the stiffening element 18, with which the upper lip 16 is connected via various screw connections 40, 41, 42, is supported with the aid of the pressure tubes 70, 71, 72, 73 on carrier 50 by means of a number of swivel bearings 22 distributed over the width of the web which are connected to the stiffening element 18 through bolts 23.

For this purpose, the bolts 23 are connected with a cross strut 86 that runs across the width of the machine parallel to carrier 50. Two adjacent pockets 66 and 67 are formed between cross strut 86 and carrier 50 on the side facing sieve 12, in which pressure tubes 70 and 71 extend. On the side facing away from sieve 12, an additional two pockets 68, 69 are formed between the cross strut 86 and a support element 74 connected to the carrier 50, in which pressure tubes 72, 73 extend. The pressure tubes 70, 71 can be acted on or actuated by a pressure source 75 via a control mechanism 76, and the pressure tubes 72, 73 can be acted on are actuated by the same pressure source 75 via a control mechanism 77.

The stiffening element 18 is fitted with a number of stiffening fins 19, extending vertically, that are arranged at regular intervals of preferably approximately 30 cm over the entire width of the machine. Each stiffening fin is provided with a swivel bearing 22 having a bolt 23 for support on the transverse strut 86 via the pressure tubes 70, 71, 72, 73.

Due to the large number of swivel bearings 22 and the associated stiffening fins instead of the previous concentrated point support as in the first embodiment, the result is a support which is nearly linear and thus practically free of deflection.

Of course, separate sources of pressure can also be provided, or all pressure tubes, which also includes tubes 47, 48, can be acted on or actuated by a single source of pressure.

In addition, the position of the upper lip 16 can be measured, both at its upper and its lower end; for this purpose, a displacement sensor 80, which measures the position of the strap 44, is provided, and an additional displacement sensor 78, which measures the position of the cross strut 86, is provided, in order to permit measurement of the size of the discharge aperture 14 and the inlet aperture 20.

Of course, the absolute size of the discharge aperture 14 and the inlet aperture 20 is additionally affected by other parameters, such as eccentricities of the sieve and the like. A number of such displacement sensors may be provided, distributed over the width of the machine.

Figure 3:
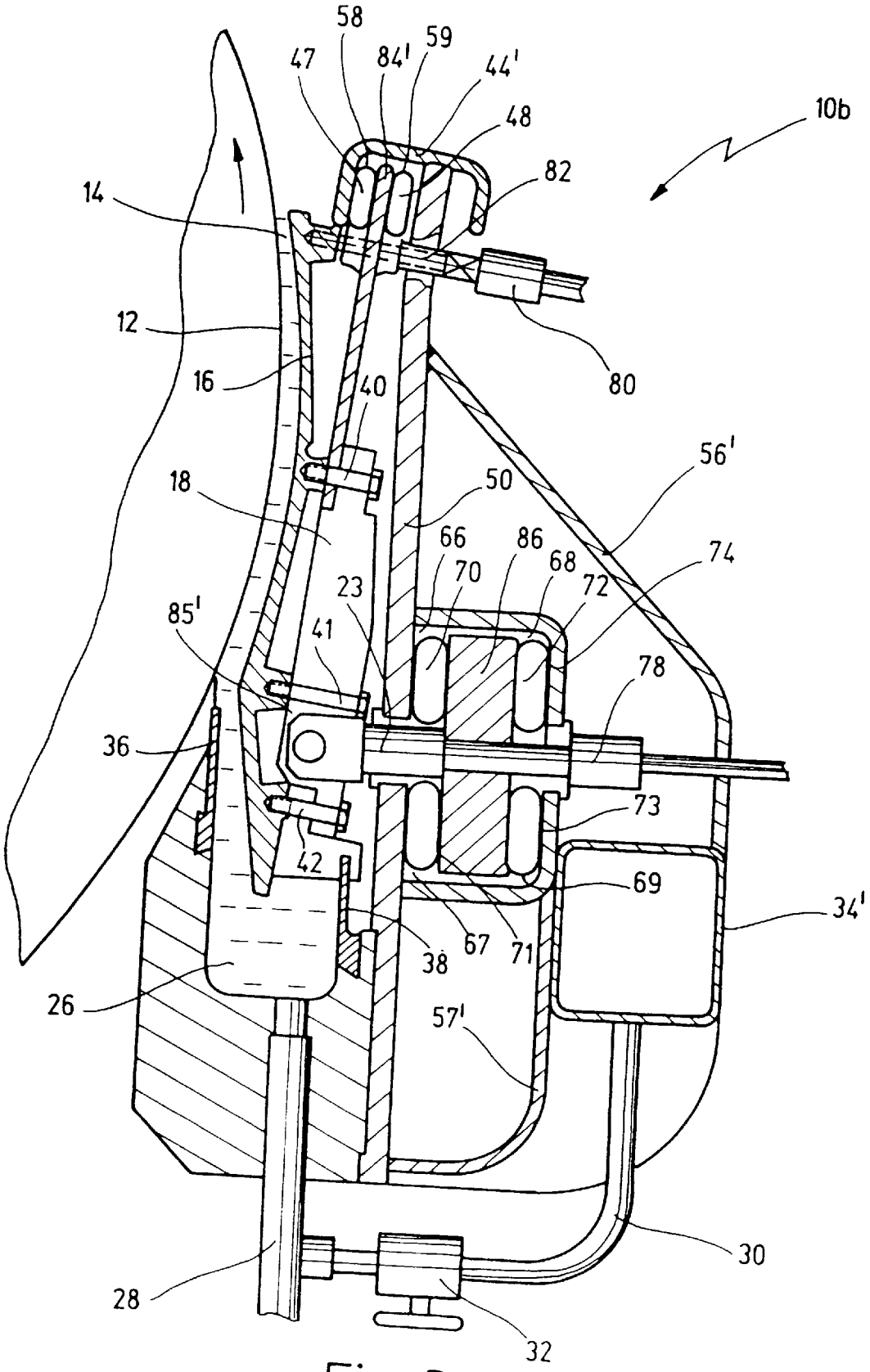

A modification of the embodiment of FIG. 2 is shown in FIG. 3 and is designated 10*b*. Accordingly, corresponding reference numbers are used here for the corresponding parts.

A first difference from former 10*a* as shown in FIG. 2 is that the initial setting of the distance between stiffening element 18 and upper lip 16 can be achieved from the outside on the side of upper lip 16 facing away from chamber 26 with the aid of a threaded spindle 82, without the necessity of dismounting the strap.

For this purpose, the strap 44' is arranged in a fashion opposite to the embodiment in FIG. 2. Specifically, the first end 84' of the stiffening element 18 is passed between the pressure tubes 47, 48, with a first pocket 47 being formed between the strap 44' and the first end 84' of the stiffening element 18, and a second pocket 59 being formed between the first end 84' of the stiffening element 18 and the carrier 50, to which the strap 44' is rigidly attached, for instance by being screw-mounted. The threaded spindle 82 passes through the carrier 50, the first end 84' of the stiffening element 18 and a threaded blind hole at the upper end of the upper lip 16. The threaded spindle 82 engages a threaded section at the upper end 84' of the stiffening element 18 and the threaded blind hole at the upper end of the upper lip 16 so that the spacing between the upper lip 16 and the stiffening element 18 can be adjusted by turning the threaded spindle 82. In this way, a preliminary adjustment of the size of the discharge aperture 14 can be achieved, in order to adjust the size of the discharge aperture 14 to a desired profiling over the width of the web. Such an adjustability can be achieved by adjustment of the various threaded spindles 82 distributed over the width of the web.

A further difference from the embodiment shown in FIG. 2 is that the transverse manifold 34', through which the thinning fluid is supplied, is used to aid in supporting the carrier 50. For this purpose, the transverse manifold 34' has an approximately square cross-section and is connected to the upper and lower ends of the carrier 50 via the supporting walls 56' and 57'.

In order to achieve deflection-free run of the carrier 50 over the width of the machine, the thinning water fed through the transverse manifold 34 is appropriately temperature controlled.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A former comprising:

a former roll having a sieve;

an adjustable discharge aperture for a fibrous material suspension; and a chamber containing the fibrous material suspension positioned between the sieve and an upper lip formed by a flow guide plate, the fibrous material suspension flowing from the chamber to the discharge aperture;

the upper lip comprising a discharge end forming the discharge aperture and a second end, the discharge end being adjustably positionable toward and away from the sieve by a pressure medium which exerts a pressure in a vicinity of the discharge end of the upper lip, wherein the discharge end of the upper lip is guided in a floating manner by at least two pressure tubes and wherein the second end of the upper lip is adjustable towards and away from the sieve.

2. A former in accordance with claim 1, wherein the upper lip is mounted for rotation on a swivel axis at the second end facing toward the chamber.

3. A former in accordance with claim 2, further comprising an adjusting device which adjusts a distance between the swivel axis and the sieve to set an inlet aperture formed between the upper lip and a lower lip.

4. A former in accordance with claim 3, wherein the chamber from which the fibrous material suspension passes into the inlet aperture between the upper lip and the lower lip is delimited by a flexible wall facing away from the sieve.

5. A former in accordance with claim 1, further comprising a movable stop provided for the upper lip in order to limit forward motion of the upper lip toward the sieve.

6. A former in accordance with claim 1, wherein the upper lip is floatingly supported by a pressure medium at the second end, opposite the discharge end, toward the chamber.

7. A former in accordance with claim 6, wherein the second end of the upper lip is floatingly guided between at least two pressure tubes.

8. A former in accordance with claim 7, wherein at least one of the at least two pressure tubes of the second end exerts a force towards the sieve when actuated by a pressure medium, another of the at least two pressure tubes exerts an opposing force when actuated by a pressure medium.

9. A former in accordance with claim 1, further comprising at least one displacement sensor provided for determining a position of the upper lip at one of the discharge end and the second end of the upper lip.

10. A former in accordance with claim 9, wherein said least one displacement sensor is coupled with one of a threaded spindle and a swivel bearing.

11. The former in accordance with claim 1, wherein the sieve is a cylindrical mold.

12. A former comprising:

a former roll having a sieve;

an adjustable discharge aperture for a fibrous material suspension;

a chamber containing the fibrous material suspension positioned between the sieve and an upper lip formed by a flow guide plate, the fibrous material suspension flowing from the chamber to the discharge aperture;

the upper lip comprising a discharge end and a second end and being adjustable toward and away from the sieve by a pressure medium, wherein the discharge end of the upper lip facing away from the chamber is guided in a floating manner by at least two pressure tubes, one tube of the two pressure tubes exerting a force toward the sieve when actuated by the pressure medium, and the second of the two pressure tubes exerting an opposing force when actuated by the pressure medium, and wherein the second end of the upper lip is adjustable towards and away from the sieve.

13. A former comprising:

a former roll having a sieve;

an adjustable discharge aperture for a fibrous material suspension;

a chamber containing the fibrous material suspension positioned between the sieve and an upper lip formed by a flow guide plate, the fibrous material suspension flowing from the chamber to the discharge aperture and, wherein the upper lip is adjustable toward and away from the sieve by a pressure medium, wherein a first end of the upper lip facing away from the chamber is guided in a floating manner by at least two pressure tubes, one tube of the two pressure tubes exerting a force toward the sieve when actuated by the pressure medium, and the second of the two pressure tubes exerting an opposing force when actuated by the pressure medium; and a stiffening element having a first end guided by the two pressure tubes and, having a second end rotatable at the swivel axis, the upper lip being attached to the stiffening element.

14. A former in accordance with claim 13, further comprising a carrier lockable in a fixed position and having a first side facing the sieve, a first pocket for accommodating the first pressure tube being provided by a spacer to the stiffening element, a second side of the carrier facing away from the sieve, a second pocket for accommodating the second pressure tube being bounded by a strap rigidly attached to the stiffening element.

15. A former in accordance with claim 14, wherein the stiffening element is provided with a number of stiffening fins arranged at regular intervals over an entire width of the former, each of the stiffening fins provided with a swivel bearing for support at a region adjacent the carrier.

16. A former comprising:

a former roll having a sieve;

an adjustable discharge aperture for a fibrous material suspension;

a chamber containing the fibrous material suspension positioned between the sieve and an upper lip formed by a flow guide plate, the fibrous material suspension flowing from the chamber to the discharge aperture and, wherein the upper lip is adjustable toward and away from the sieve by a pressure medium, wherein a first end of the upper lip facing away from the chamber is guided in a floating manner by at least two pressure tubes, one tube of the two pressure tubes exerting a force toward the sieve when actuated by the pressure medium, and the second of the two pressure tubes exerting an opposing force when actuated by the pressure medium; and wherein one of the two pressure tubes is actuated by a constant working pressure, the other pressure tube being actuated by an adjustable working pressure.

17. A former in accordance with claim 16, wherein one of the two pressure tubes is coupled with a lifting device that lifts the upper lip from the sieve at startup, shutdown and operational interruptions of the former.

18. A former comprising:

a former roll having a sieve;

an adjustable discharge aperture for a fibrous material suspension;

a chamber containing the fibrous material suspension positioned between the sieve and an upper lip formed by a flow guide plate, the fibrous material suspension flowing from the chamber to the discharge aperture and, wherein the upper lip is adjustable toward and away from the sieve by a pressure medium, wherein the upper lip is floatingly supported by a pressure medium at a second end toward the chamber, and wherein the upper lip is attached to a stiffening element guided by at least two pressure tubes and supported by a carrier at both a first end, facing away from the chamber, and a second end facing the chamber.

19. A former comprising:

a former roll having a sieve;

an adjustable discharge aperture for a fibrous material suspension;

a chamber containing the fibrous material suspension positioned between the sieve and an upper lip formed by a flow guide plate, the fibrous material suspension flowing from the chamber to the discharge aperture and, wherein the upper lip is adjustable toward and away from the sieve by a pressure medium, wherein the upper lip is floatingly supported by a pressure medium at a second end toward the chamber, and wherein the second end of the upper lip is supported by a number of swivel bearings distributed over a width of the former on a cross strut, which is supported by pairs of adjacent pressure tubes on the stiffening element that extend in pockets between the cross strut and the stiffening element on a side facing toward the sieve and in pockets between the cross strut and a support element rigidly connected to the stiffening element on a side facing away from the sieve.

20. A former comprising:

a former roll having a sieve;

an adjustable discharge aperture for a fibrous material suspension;

a chamber containing the fibrous material suspension positioned between the sieve and an upper lip formed by a flow guide plate, the fibrous material suspension flowing from the chamber to the discharge aperture and, wherein the upper lip is adjustable toward and away from the sieve by a pressure medium; and a pocket facing toward the sieve for enclosing a pressure tube, the pocket being located between a first end of a stiffening element, which faces away from the chamber, and a strap rigidly attached to a carrier, a second pocket facing away from the sieve enclosing a second pressure tube, the second pocket being located between the carrier and the stiffening element.

21. A former in accordance with claim 20, wherein a threaded spindle passes through the carrier and the stiffening element and engages with a threaded section of the stiffening element and the upper lip.

22. A former in accordance with claim 20, further comprising a transverse manifold provided for the admixing of fluids in the chamber, the manifold being rigidly connected to the carrier by braces and can be temperature controlled so that the carrier remains free of deflection.

* * * * *